US006148554A

United States Patent [19]

Dietrich et al.

[11] Patent Number: 6,148,554

[45] **Date of Patent: *Nov. 21, 2000**

[54] DEVICE FOR ACCOMMODATING A PLANIFORM ADVERTISING CARRIER

[76] Inventors: Thomas Dietrich, Hauptstr. 63; Rainer Kunze, Hauptstr. 107a, both of D-37318 Lutter; Michael Lazar, Herwigsmühlenweg 3c, D-34123 Kassel, all of Germany

[ * ] Notice: This patent is subject to a terminal disclaimer.

[21] Appl. No.: 09/174,339

[22] Filed: Oct. 19, 1998

Related U.S. Application Data

[63] Continuation-in-part of application No. 08/879,412, Jun. 20, 1997, Pat. No. 5,941,001.

[30] Foreign Application Priority Data

Jul. 16, 1998 [DE] Germany ..... 298 12 658 U
Jul. 29, 1998 [DE] Germany ..... 298 13 483 U

[51] Int. Cl.[7] ..... G09F 17/00

[52] U.S. Cl. ..... 40/603; 40/604

[58] Field of Search ..... 40/601, 603, 604; 160/333, 338, 339

[56] References Cited

U.S. PATENT DOCUMENTS

| | | | |
|---|---|---|---|
| 5,555,659 | 9/1996 | Hade | 40/604 |
| 5,845,423 | 12/1998 | Hicks | 40/603 |
| 5,893,226 | 4/1999 | Sophocleous et al. | 40/603 X |
| 5,941,001 | 8/1999 | Dietrich et al. | 40/603 |

*Primary Examiner*—Lynne H. Browne
*Assistant Examiner*—Robert G. Santos
*Attorney, Agent, or Firm*—Thomas R. Vigil

[57] ABSTRACT

The device is used for accommodating a planiform advertising carrier (10) with two bars (3,4) arranged on top of each other and for keeping the advertising carrier (10) tenterable. The advertising carrier is laterally tenterable, for lateral tentering. Further the advertising carrier (10) is provided at least on one side with a tentering device which comprises a rail (20) which takes laterally hold of the advertising carrier and a tentering device (70) by means of which the rail (20) is movable for the lateral tentering of the advertising carrier, the advertising carrier (10) being held on the other side against the tentering direction.

16 Claims, 2 Drawing Sheets

DEVICE FOR ACCOMMODATING A PLANIFORM ADVERTISING CARRIER

CROSS-REFERENCE TO RELATED APPLICATIONS

This application is a continuation-in-part of U.S. Ser. No. 08/879,412 filed on Jun. 20, 1997 for: DEVICE FOR ACCOMMODATING A PLANIFORM CARRIER, NOW U.S. Pat. No. 5,941,001 issued Aug. 24, 1999.

BACKGROUND OF THE INVENTION

1. Field of the Invention

The present invention concerns a device for accommodating a planiform advertising carrier with two bars arranged on top of each other and which keep the advertising carrier tenterable, whereas the advertising carrier is laterally tenterable.

2. Description of the Prior Art

Many different versions of large planiform advertising carriers are known; they are e.g. designed as printed foils or fabrics, and are to be fastened on house walls. Such advertising carriers often extend over several square meters. Therefore, with regard to security, great demands are made upon the fastening procedure of such an advertising carrier onto a house wall or similar structure, since such an advertising carrier must also be able to withstand a stronger wind impact.

The earlier U.S. application Ser. No. 08/879,412 discloses a device of the type mentioned above by means of which big planiform advertising carriers may be placed securely onto house walls. The advertising carrier is hereby tentered between two bars arranged on top of each other, whereas the upper bar is pulled upwards alongside the house wall where it is fastened, and whereas the other lower bar is fastened onto the house wall against the tentering direction of the upper bar. The bars keep the planiform advertising carrier under a certain pretension, preventing it from creasing, which would make a bad impression on the potential customer. U.S. Ser. No. 08/879,412 already suggested to tenter the advertising carrier also sideways by means of turnbuckles, trigger snaps and eyes in order to prevent the advertising carrier from contracting on its long sides because of the vertical tension. Experience has taught that though the arrangement of individual turnbuckles over the length of the advertising carrier does not bring the desired result, since there are still constrictions on the advertising carrier between the points of application of the individual turnbuckles, these constrictions disturb the general appearance of the advertising carrier.

Additionally, the eyes in the advertising carrier on which the turnbuckles are fastened by means of trigger snaps easily tear out, since the strain on the eyes is very strong, especially when wind is blowing.

Another disadvantage is that, in order to change the advertising carrier, the turnbuckles have to be released first before the trigger snaps, which are held by the advertising carrier's eyes, may be opened. That means that this known device for lateral tentering makes the changing of such an advertising carrier very complicated.

SUMMARY OF THE INVENTION

An object of the present invention is therefore to provide a device of the type mentioned above that makes changing of the advertising carrier with lateral tentering easily possible, whereas it should be guaranteed that even in case of stronger wind, the advertising carrier may securely be maintained on the building's facade.

The solution of this object is to provide the advertising carrier at least on one side with a tentering device for lateral tentering, the tentering device comprising a rail which takes laterally hold of the advertising carrier and a tentering device by means of which the rail for the lateral tentering of the advertising carrier is movable, the advertising carrier being held on the other, opposite side against the tentering direction. This explains that the advertising carrier is laterally tentered in that a rail, which is also laterally movable, is taking hold of the advertising carrier on one of its long sides, whereas on the other, opposite long side another rail may be provided that takes hold of the advertising carrier, this rail being fixed, that means it should not be movable along the house wall. The use of such a rail makes a crease-free tentering of the advertising carrier possible.

The tentering device is designed as being elastic, for example as a gas pressure spring, the rail standing under the pretension of such a gas pressure spring, whereas, in case of particularly big advertising carriers, several such tentering device, for example of gas pressure springs, may be arranged on top of each other in order to achieve an even tentering of the advertising carrier on a house wall. The tentering device itself is arranged on a bearing bracket, whereas the rail is advantageously provided with a carriage guided through a guiding element for the lateral slidability of the rail. Such a construction clearly shows that, when using for example a gas pressure spring as a tentering device, the carriage guided in the guiding element prevents the piston of the gas pressure spring from breaking out sideways. Together with the carriage provided with the rail, the guiding element on the contrary makes it possible for the piston of the gas spring to move absolutely horizontally.

To loosen the advertising carrier, the rail is movable by means of a cable pull against the direction of the tentering device's pretension, loosening thus the planiform advertising carrier. The cable pull, which may be arranged on the bearing bracket for the tentering device, is advantageously provided with a cable winch. That means that the cable winch pulls the rail, taking laterally hold of the planiform advertising carrier towards the bearing bracket, i.e. against the tentering direction, for example of the gas pressure spring. The thus released advertising carrier may then be taken out of the rail. The planiform advertising carrier advantageously is provided hereby at its ends with a bead or swelling for the rail to take hold of, the rail being provided with a corresponding groove into which the swelling may preferably be introduced with its end. That means that, once released, the advertising carrier may be taken out of or introduced into the rail by its swelling.

The bars receiving the planiform advertising carrier are guided through guiding elements, whereas the guiding elements are arranged on the house wall or on the building's facade. The upper bar is movable along the guiding element by means of a cable pull for tentering the advertising carrier arranged between the two bars arranged on top of each other. The device is provided with a stopper for the lower bar for the vertical tentering of the advertising carrier, the lower bar being preferably spring-loaded in order to keep the advertising carrier under pretension. Such a tentering device for tentering vertically the planiform advertising carrier is known from U.S. Pat. No. 5,941,001, and that's why it is cited as reference.

DESCRIPTION OF THE PREFERRED EMBODIMENT(S)

Figure 1:
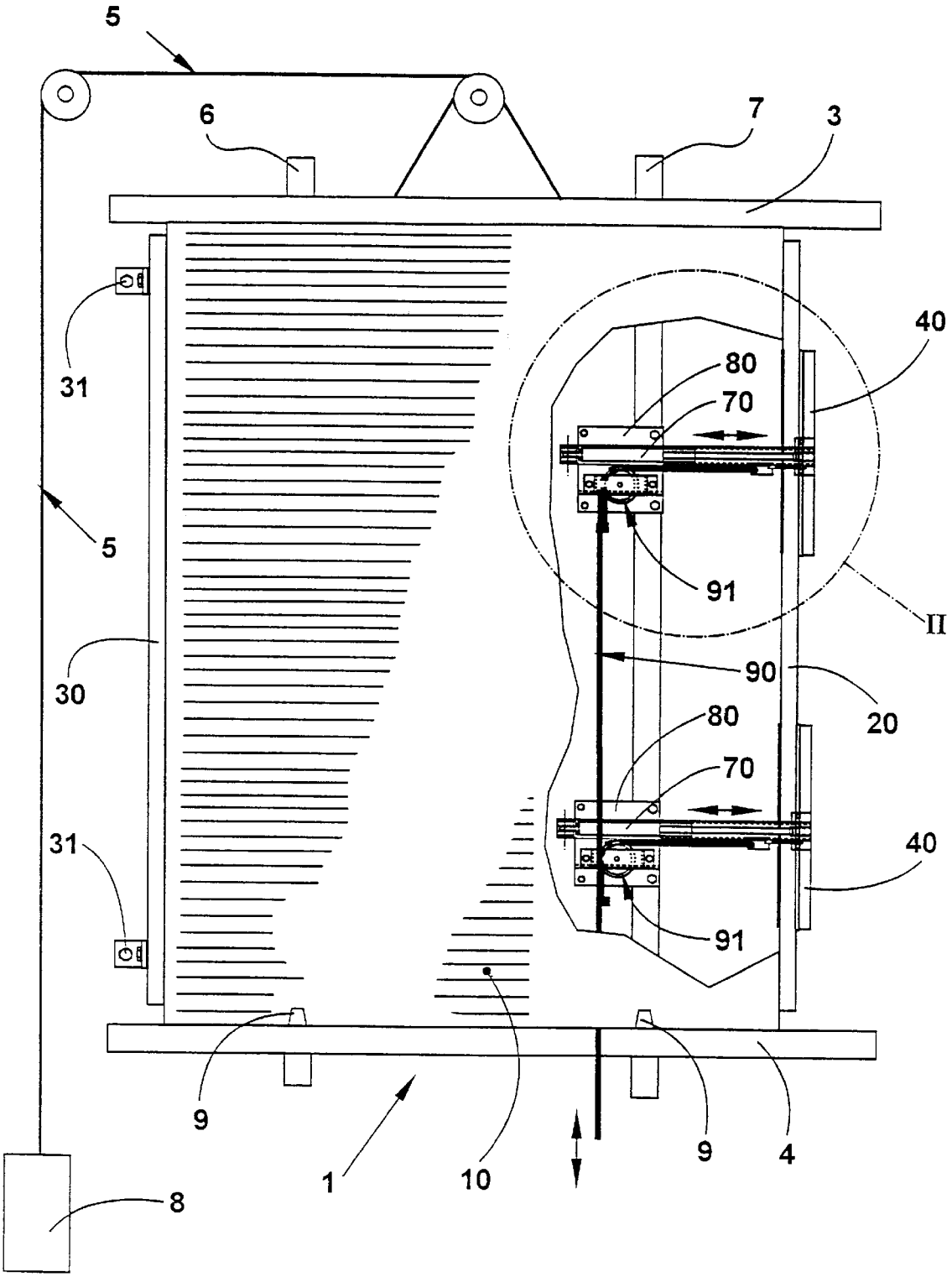
FIG. 1 is a frontal schematic view of the device of the present invention for accommodating a planiform advertising carrier.

According to FIG. 1, the device referred to as a whole with numeral 1 has two bars 3 and 4 arranged on top of each other. The bars 3 and 4 are guided in parallel running guiding elements 6 and 7 arranged on the house wall. Bar 3 is moved relative to bar 4 by means of the cable pull referred to as a whole with numeral 5 along the guiding elements 6 and 7, whereas the cable pull is preferably connectable to a cable winch 8. In order to keep the planiform advertising carrier 10, which is tenterably taken hold of by the two bars 3 and 4, under tension, two spring-loaded stoppers 9 are provided, against which bar 4 is tentered.

Figure 2:
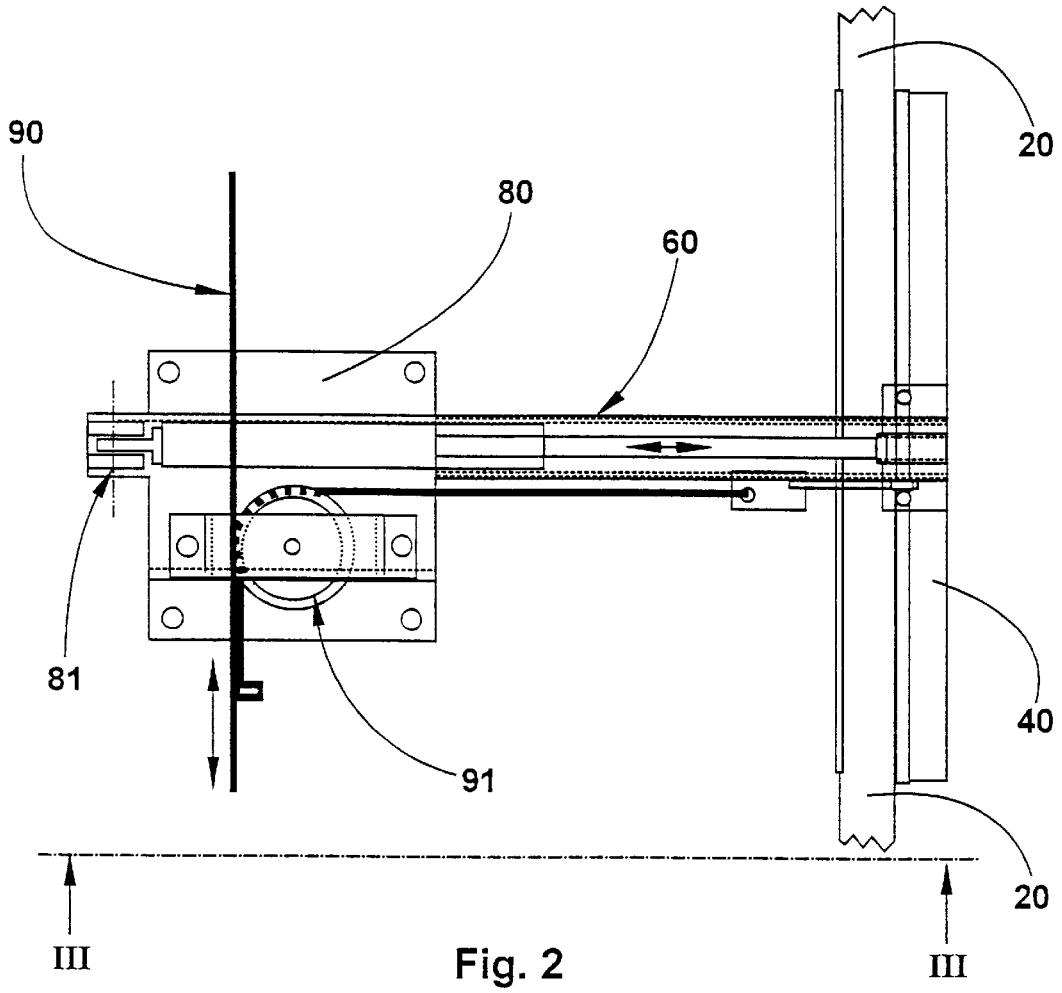
FIG. 2 is an enlargement of cutout II of FIG. 1.
Figure 3:
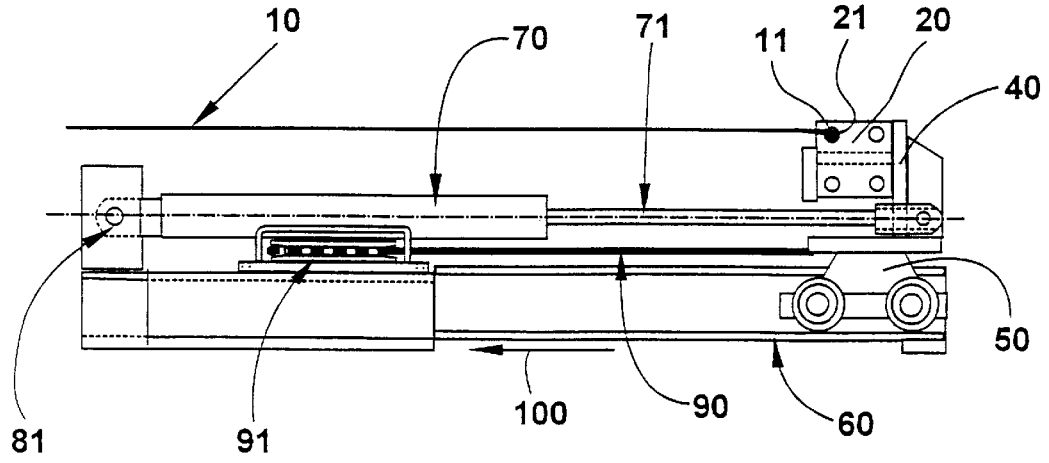
FIG. 3 is a view along the line III—III of FIG. 2.

What is actually of interest is the device for the lateral tentering of the advertising carrier 10. This device is shown in detail in FIGS. 2 and 3. The tentering device for the lateral tentering of advertising carrier 10 comprises two rails 20, 30, whereas rail 30 is fastened on the house wall by means of fastening device 31. On the other, opposite side, there is the rail 20 that, as already explained, receives the advertising carrier 10 so that the bead or swelling 11 of advertising carrier 10 is guided in a groove 21 of rail 20. The fastening of the advertising carrier on the rail 30 occurs in a similar way. The rail 20 is held by an arm 40 fastened on a carriage referred to as a whole with numeral 50. The carriage 50 is guided in a guiding element 60. The piston rod 71 of gas pressure spring 70 is engaged on the arm 40. The gas pressure spring 70 itself is pivotably accommodated on the bearing bracket 80 by means of an articulation 81.

The carriage 50 is coupled with cable pull 90. Cable pull 90, which is deviated onto a reel 91 arranged on the bearing bracket 80, serves to move the piston rod 71 of gas pressure spring 70 in the direction of the arrow 100, hereby releasing the planiform advertising carrier 10 and guiding it in this position either into or out of the groove 21 of rail 20. As may be seen in FIG. 1, several such tentering device designed as gas pressure springs may be provided on top of each other on big planiform advertising carriers. In this case, the individual cable pulls 90 are all linked together, in order to become actuated by one single cable winch.

What is claimed is:

1. Device for accommodating a, and for attachment to a, planiform advertising carrier (10) between two bars (3,4) arranged on top of each other and which keep the advertising carrier (10) tenterable between the two bars (3,4), said advertising carrier being laterally tenterable, and, characterized in that, for lateral tentering, the advertising carrier (10) is provided, at least on one side, with a tentering device, the tentering device comprising a rail (20) which takes lateral hold of the advertising carrier and a tentering means (70) by means of which the rail (20) is movable for the lateral tentering of the advertising carrier, the advertising carrier (10) being held on the side opposite said tentering means against the direction of a tentering force of said tentering means, and said rail (20) being movable against the direction of said tentering force of said tentering means (70). thereby to provide loosening of the planiform advertising carrier (10).

2. Device according to claim 1, characterized in that, on the side opposite said tentering means, the advertising carrier (10) is receivable by a rail (30) by which the advertising carrier (10) is fastened.

3. Device according to claim 1, characterized in that the tentering means (70) are elastic.

4. Device according to claim 3, characterized in that the tentering means is designed as a gas pressure spring (70).

5. Device according to claim 3, characterized in that the tentering means (70) is arranged on a bearing bracket (80).

6. Device according to claim 1, characterized in that the rail (20) is provided with a carriage (50) for the lateral slidability of the rail (20), the carriage being guided by a guiding element (60).

7. Device according to claim 1, characterized in that the rail (20) is movable by means of a cable pull (90) against the direction of the tentering force of the tentering means (70), thereby to loosen the planiform advertising carrier (10).

8. Device according to claim 7, characterized in that the cable pull (90) is accommodated on the bearing bracket (80).

9. Device according to claim 7, characterized in that the cable pull (90) is provided with a cable winch.

10. Device according to claim 1 in combination with a planiform advertising carrier, characterized in that the planiform advertising carrier (10) is provided on each side with an elongate swelling or bead (11) for engaging the rail (20), and the rail (20) being provided with a corresponding groove (21) into which the swelling or bead (11) may be introduced.

11. Device according to claim 10, characterized in that the swelling (11) is introducible by its end into the groove (21) of rail (20).

12. Device according to claim 1 in combination with guiding elements (6,7), characterized in that the bars (3,4) receiving the planiform advertising carrier (10) are guided through said guiding elements (6,7).

13. Device according to claim 12, characterized in that the upper bar (3) is movable along the guiding elements (6,7) by means of a cable pull (5) for tentering the advertising carrier (10) arranged between the two bars (3,4) accommodated on top of each other.

14. Device according to claim 12, characterized in that the device (1) is provided with a stopper (9) for the lower bar (4).

15. Device according to claim 14, characterized in that the stopper (9) is spring-loaded.

16. Device according to claim 1 including moving means for moving said rail against the tentering force of said tentering means, thereby to provide a loosening of said planiform advertising carrier.

* * * * *